US009725922B2

(12) United States Patent
Dyeson et al.

(10) Patent No.: US 9,725,922 B2
(45) **Date of Patent: *Aug. 8, 2017**

(54) ALL-WEATHER, PORTABLE AND MODULAR AWNING SYSTEM

(71) Applicant: Duck-N-Cover Awnings, Inc., Chehalis, WA (US)

(72) Inventors: Timothy B. Dyeson, Chehalis, WA (US); Erica L. Dyeson, Chehalis, WA (US)

(73) Assignee: Duck-N-Cover Awnings, Inc., Chehalis, WA (US)

( * ) Notice: Subject to any disclaimer, the term of this patent is extended or adjusted under 35 U.S.C. 154(b) by 250 days.

This patent is subject to a terminal disclaimer.

(21) Appl. No.: 14/616,428

(22) Filed: Feb. 6, 2015

(65) Prior Publication Data

US 2016/0230411 A1 Aug. 11, 2016

(51) Int. Cl.

| | |
|---|---|
| ***E04H 15/58*** | (2006.01) |
| ***E04H 15/36*** | (2006.01) |
| ***E04D 13/064*** | (2006.01) |

(52) U.S. Cl.

CPC ..... *E04H 15/58* (2013.01); *E04H 15/36* (2013.01); *E04D 13/064* (2013.01)

(58) Field of Classification Search

CPC ..... E04H 15/58; E04H 15/36; E04D 13/064

USPC ..... 135/906

See application file for complete search history.

(56) References Cited

U.S. PATENT DOCUMENTS

| | | | | | |
|---|---|---|---|---|---|
| 1,607,020 | A * | 11/1926 | Stoll | E04H 15/58 | 135/117 |
| 1,846,011 | A * | 2/1932 | Adams | E04H 15/48 | 135/117 |
| 1,900,335 | A * | 3/1933 | Del Vecchio | E04H 15/48 | 135/118 |

(Continued)

FOREIGN PATENT DOCUMENTS

| | | | | |
|---|---|---|---|---|
| DE | 19904221 | A1 * | 8/2000 | E04D 13/064 |
| FR | 3009574 | A1 * | 2/2015 | E04F 10/02 |
| TW | GB 2362395 | A * | 11/2001 | E04H 15/44 |

OTHER PUBLICATIONS

English translation of FR 3,009,574 A1 from espacenet.com.*

*Primary Examiner* — David R Dunn
*Assistant Examiner* — Danielle Jackson
(74) *Attorney, Agent, or Firm* — Lowe Graham Jones PLLC

(57) ABSTRACT

An awning system for a canopy that couples to two legs of the canopy is disclosed. The awing includes a fabric cover and frameworks. The supportive frameworks include a pair of side supports, each attached to a leg of the canopy and a laterally telescoping crossbeam that attaches to the distal ends of the side supports. The frameworks further include a plurality of tent poles connected perpendicularly to the side supports. The poles support the fabric cover in an upwardly arched shape to facilitate the shedding of water. A tension pole is connected to the bottom of a proximal fabric panel and the top of the distal fabric panel using a system of fabric pockets. The fabric cover is removably attached to the frameworks. The awning provides all-weather protection and may display a sign. Removable rain gutters attach to the awning supports and channel water down legs of the canopy.

16 Claims, 6 Drawing Sheets

(56) References Cited

U.S. PATENT DOCUMENTS 2,151,908 A * 3/1939 Gottlieb ..... E04B 1/3441 135/117
2,182,283 A * 12/1939 Curtis ..... E04H 15/48 135/117
2,265,479 A * 12/1941 Goodman ..... E04H 15/58 135/140
2,967,533 A * 1/1961 Ballinger ..... E04H 15/46 135/140
3,355,895 A * 12/1967 Bayes ..... E04D 13/064 405/120
4,100,703 A * 7/1978 Sickler ..... E04D 13/064 52/16
5,035,253 A * 7/1991 Bortles ..... E04H 15/50 135/117
5,437,138 A * 8/1995 Tuohey ..... E04D 13/064 248/48.2
6,478,039 B2 * 11/2002 Suh ..... E04H 15/50 135/120.3
6,718,995 B2 * 4/2004 Dotterweich ..... E04H 15/50 135/117
7,240,685 B2 * 7/2007 Seo ..... E04H 15/50 135/120.3
7,299,812 B2 * 11/2007 Carter ..... E04H 15/58 135/117
7,328,935 B1 * 2/2008 Tarin ..... E04H 15/06 135/88.12
7,775,229 B2 * 8/2010 Sy-Facunda ..... E04H 15/48 135/117
8,132,583 B2 * 3/2012 Mowatt, Sr. ..... E04F 10/0603 135/117
8,978,680 B2 * 3/2015 Kayser ..... E04H 15/44 135/120.3
9,243,386 B2 * 1/2016 Perlatti ..... E03B 3/02
9,410,341 B1 * 8/2016 Welch ..... E04H 4/108
2005/0178417 A1 * 8/2005 Holub ..... E04H 15/54 135/115
2006/0150532 A1 * 7/2006 Quinci ..... E04D 13/064 52/16
2012/0103377 A1 * 5/2012 Sheridan ..... E04H 15/58 135/91
2015/0211252 A1 * 7/2015 Park ..... E04H 15/58 135/96
2015/0252587 A1 * 9/2015 Lovley, II ..... E04H 15/00 135/121

* cited by examiner

ALL-WEATHER, PORTABLE AND MODULAR AWNING SYSTEM

FIELD OF THE INVENTION

The present disclosure relates generally to the field of portable, collapsible and tent-like canopies. More specifically, the disclosure pertains to a detachable all-weather awning system that extends the protection of available tent-like portable canopies.

BACKGROUND OF THE INVENTION

Portable, freestanding and readily collapsible tent canopies that are easily transported and rapidly set up are useful for outdoor gatherings. Such tent canopies provide particular utility at farmers markets, flea markets, sporting events, and the like.

For instance, such tent canopies provide temporary and partial protection and shelter from the weather and other elements. However, this protection is not complete. Persons or products underneath the canopy may still be exposed to the sun or rain. In scenarios where additional canopies cannot be utilized to provide additional protection from the weather, a detachable awning is often a preferred solution.

Detachable awnings are currently available. However, these awnings are not all-weather awnings. For example, these awnings do not effectively shed water. Without shedding water, the persons or products below are at risk, via a collecting pool of water. Furthermore, existing awning systems do not typically accommodate taller persons.

An awning that provides additional shade, effective protection from the rain, ample headroom for taller persons, and serves as a holder for a sign is desired. It is for these and other concerns that the following disclosure is presented herein.

SUMMARY OF THE INVENTION

The present disclosure is directed towards modular awning systems and assemblies. In some embodiments, a modular all-weather awning system is configured and arranged to removably couple to a canopy that includes a first and a second leg. The system provides protection from weather elements. The system includes a frame assembly and a cover that is configured and arranged to couple to the frame. The frame assembly includes a cross member, a first support member, and a second support member. The cross member includes a first and a second end. The first support member includes a first canopy coupler positioned at a first proximal end of the first support member and a first receiver coupler positioned at a first distal end of the first support member. The second support member includes a second canopy coupler positioned at a second proximal end of the second support member and a second receiver coupler positioned at a second distal end of the second support member.

A frame is formed by coupling the first receiver coupler to the cross member's first end and by coupling the second receiver coupler to the cross member's second end. The first and second support members are substantially parallel members and each is substantially orthogonal to the cross member. The frame couples to the canopy by coupling the first canopy coupler to the canopy's first leg and coupling the second canopy coupler to the canopy's second leg. The cover provides protection, from the weather elements, to an area below the frame.

In some embodiments, the frame assembly further comprises a plurality of lateral members that form an arch structure when the cover is coupled to the frame. The first canopy coupler includes a trench and a back plate. The trench is configured and arranged to receive the canopy's first leg. The back plate is configured and arranged to couple to the trench and secure a positioning of the first leg when received by the trench. The back plate includes a slot to receive a fastener that couples the back plate to the trench.

In at least one embodiment, the cover includes a securing strap that at least partially enables coupling the cover to the first support member. The first support member includes a retaining lip that is configured and arranged to secure a positioning of the securing strap about the first support member.

The system may further includes one or more a rain gutters that are configured and arranged to couple to at least one of the first or second support members and collect water that is incident on the cover. The rain gutters each include an exit aperture and a fabric downspout. The downspouts are configured and arranged to be coupled between the exit aperture and the canopy's first and second legs. The cover includes a distal panel and a proximate panel. The distal panel is positioned vertically. The proximate panel couples to a fabric included in the canopy.

In various embodiments, an awning assembly includes a frame, a fabric cover, and a rain gutter. The frame includes a first and a second canopy fastener and a cross member. The first and the second canopy fasteners are configured and arranged to couple the frame to a canopy assembly. A width of the frame is adjustable based on an adjustable length of the cross member. The fabric cover is configured and arranged to stretch over the frame. The rain gutter is configured and arrange to couple to the frame and collect and channel moisture from the fabric cover.

In a preferred embodiment, the frame includes an arch such that when the cover is stretched over the frame, the cover is arched to enhance the collection of moisture in the rain gutters. The arch is at least partially formed by a flexible tent pole. The fabric cover includes a vertical portion that is substantially orthogonal to the rain gutters. In various embodiments, the assembly further includes a placard that is configured and arranged to couple to the vertical portion of the fabric cover. Each of the first and the second canopy fasteners includes a quick-release clamp.

In at least one embodiment, a detachable all-weather awning for a portable canopy includes a framework and an awning cover. The framework includes a proximal arched tent pole, a medial arched tent pole, a distal arched tent pole, a first side arm, a second arm, and a telescoping cross beam. The first and second side arms are configured and arranged to be attached to the canopy. The awning cover includes an arch-shaped proximal fabric panel and an arch-shaped distal fabric panel. The proximal fabric panel extends downward vertically from the proximal tent pole to a frame of the portable canopy. The distal fabric panel extends downward vertically from the distal tent pole to the telescoping cross beam. The fabric cover may further include a horizontally placed medial fabric panel attached to the proximal and distal fabric panels.

In a preferred embodiment, the awning further includes detachable rain gutters. The rain gutters include a first retainer clip, a second retainer clip, and a fabric downspout. Each of the first and the second retainer clips are enabled to attach the rain gutters to the first and second side arm of the framework. The fabric downspout includes a fastener enabled to attach the downspout to a leg of the canopy. The rain gutters may further include a transectionally and longitudinally cut member of a pipe, a longitudinally cut end-cap, and a drain hole at the end of the pipe. The end-cap is connected to an end portion of the pipe.

The framework includes a four-sided clamp that attaches the first side arm to a first leg of the canopy. The 4-sided clamp includes a 3-sided main clamp body and a back plate. The 3-sided main clamp body attaches to the first leg of the canopy. The back plate completes the 4-sided clamp and secures a position of the 4-sided clamp about the first leg of the canopy.

In at least one embodiment, the telescoping cross beam includes an outer tube, a long inner tube, and a short inner tube. The long inner tube telescopes laterally within the outer tube and has a first aperture at a lateral end that is configured and arranged to receive a pin. The short inner tube is coupled to the lateral end of the long inner tube and has a second aperture that is configured and arranged to receive the pin.

BRIEF DESCRIPTION OF THE DRAWINGS

Preferred and alternative examples of the present invention are described in detail below with reference to the following drawings.

DETAILED DESCRIPTION

Figure 1:
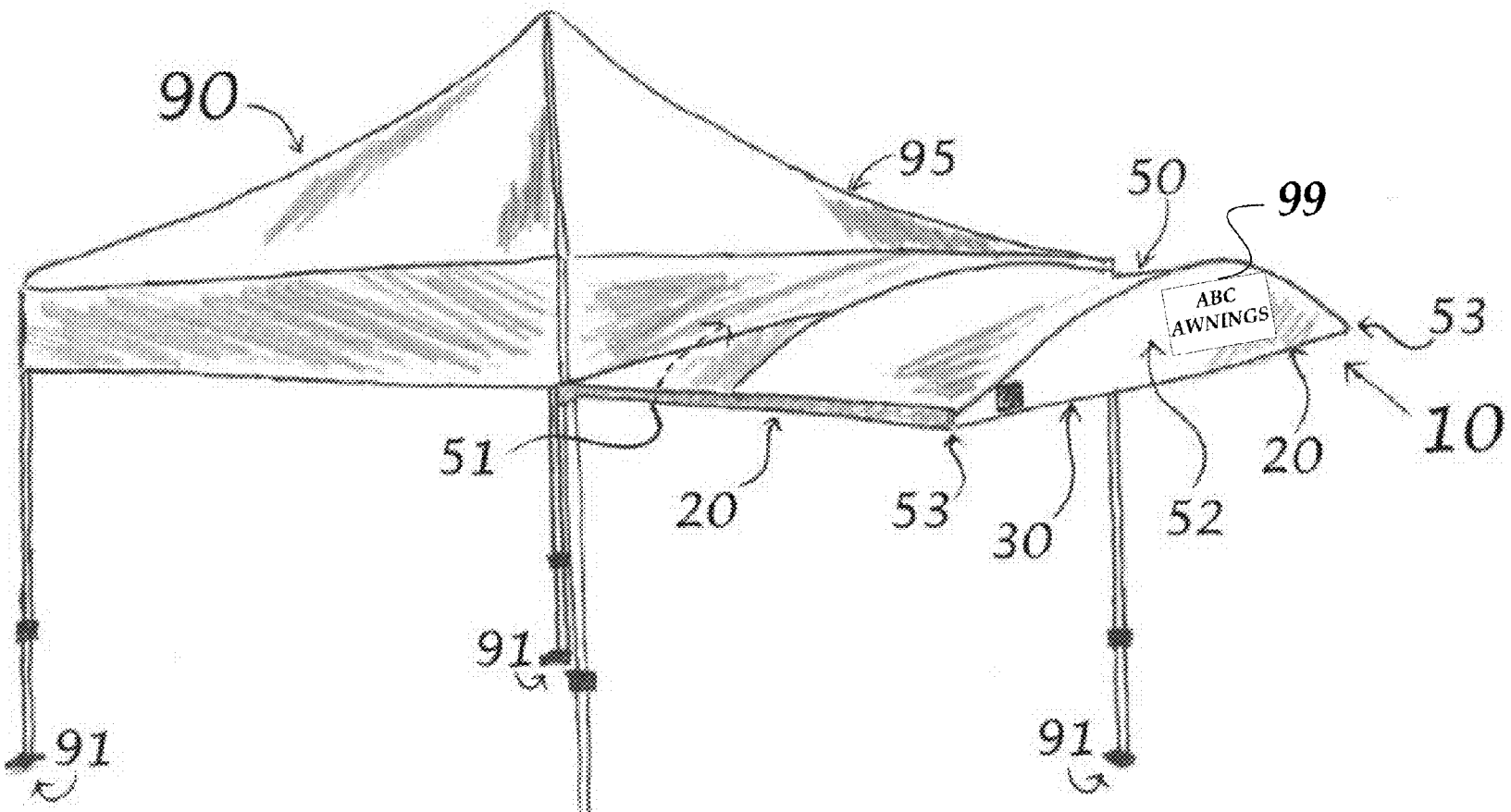
FIG. 1 illustrates a modular awning system that is coupled to a canopy and is consistent with the various embodiments described herein.

Various embodiments of an all-weather awning system for a portable canopy are disclosed herein. The all-weather awning is detachable and portable and meant to be installed when the portable canopy is in use. One purpose of the all-weather awning system is to provide additional protection for products and people from the sun and rain.

One advantage of this all-weather awning system is a supported arched design. The supported arch design effectively sheds water during periods of rain and provides ample headroom for taller individuals. The arched design is supported by the use of lateral support structures, such as tent poles. The lateral support structures serve two purposes: (1) enable the water-shedding arch and (2) provide lateral tension to an aluminum framework. Both purposes serve to facilitate the tautness of the fabric cover.

The awning support system includes a fabric cover and a pair of lateral side supports, each enabled for coupling to the legs of the portable canopy. Each side support includes a universal four-sided quick-release clamp positioned at a proximal end. Furthermore, the side supports include a fixed 90° receiver joint positioned at the distal end. The system also includes a telescoping cross beam. The 90° receiver joints of the lateral side supports couple to and provide support for the telescoping cross beam. Each side support also contains receiver pins that provide support for the tent poles. Further, each side support includes couplers or fasteners that mate with similar fasteners sewn into the lateral sides of the fabric cover. The fabric cover is tautly secured. Each side support also supports a detachable rain gutter system.

Other features and many attendant advantages of the invention will become more apparent upon a reading of the following detailed description together with the drawings wherein like reference numerals refer to like parts throughout.

FIG. 1 illustrates a modular awning system 10 that is coupled to a canopy 90 and is consistent with the various embodiments described herein. The portable canopy 90 includes a plurality of vertical legs 91 and a fabric roof 95.

The detachable all-weather awning system 10 includes two support arms 20 and a cross beam 30. In preferred embodiments, the cross beam 30 is a telescoping cross beam. Each of the support arms 20 couples to one of the canopy's vertical legs 91 to couple the awning system 10 to the canopy 90. The two support arms 20 are coupled at the distal ends by the cross beam 30.

Figure 2:
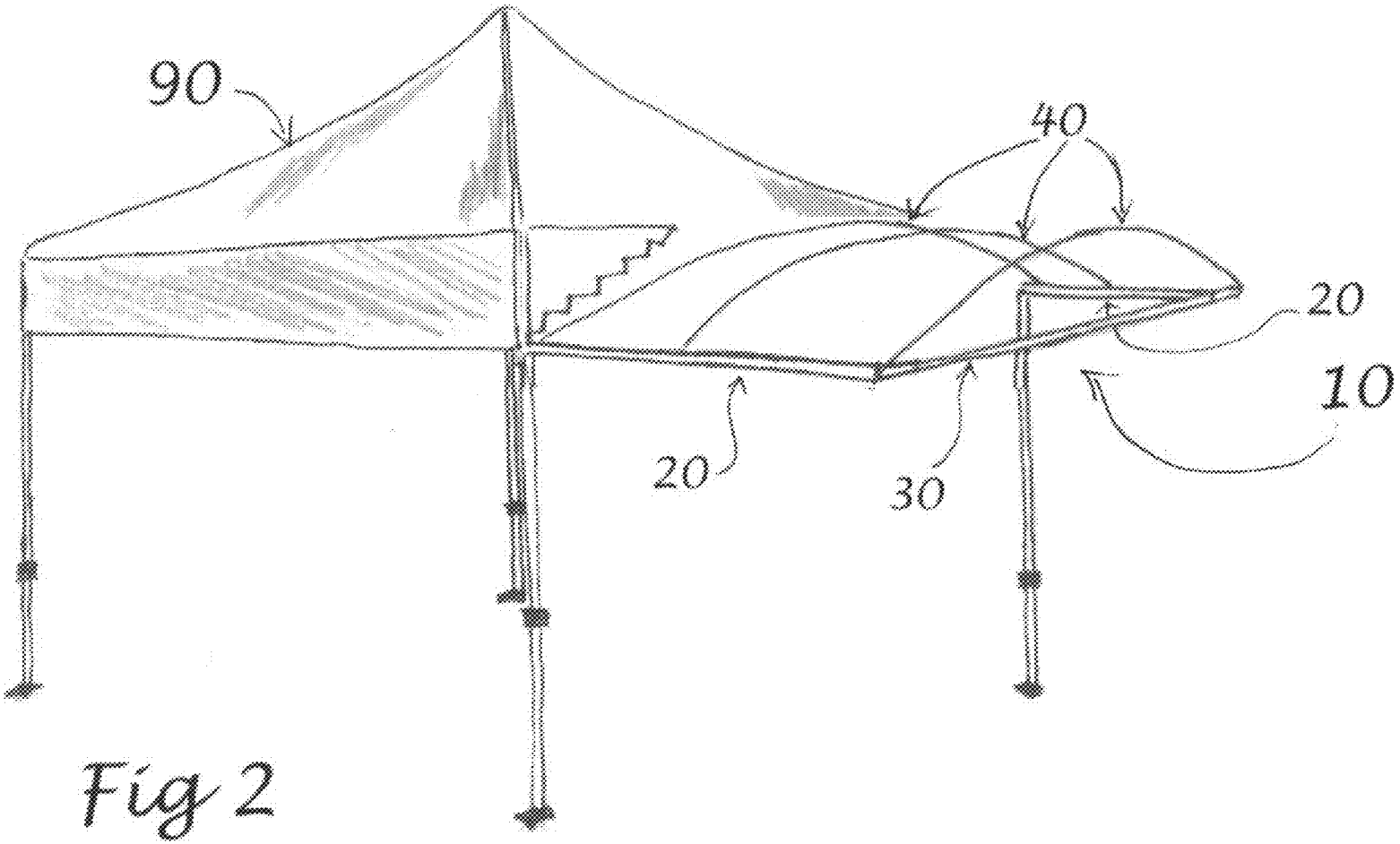
FIG. 2 shows the frameworks included in the modular awning system of FIG. 1, wherein the structures are coupled to the canopy of FIG. 1 and are consistent with the various embodiments disclosed herein.

The awning system 10 further includes a plurality of lateral poles. In some embodiments, the lateral poles are similar or equivalent to the tent poles 40 of FIG. 2. The support beams 20, the cross beam 30, and the plurality of tent poles 40 make up the frameworks or frame of the awning system 10. FIG. 2 shows the frameworks of the modular awning system 10 coupled to the canopy 90. Specifically, FIG. 2 illustrates the two support arms 20 coupled to the canopy's 90 vertical legs and the telescoping cross bar 30 attached to the distal ends of the support arms 20. The plurality of arched tent poles 40 are also shown to complete the frameworks of the awning system 10. The frameworks provide support and structure to the awning system 10.

Referring back to FIG. 1, the awning system also includes a fabric cover 50, to provide shelter and protection. The fabric cover 50 is stretched over and coupled to at least a portion of the frameworks shown in FIG. 2. In some embodiments, the fabric cover 50 is coupled to the support arms 20 by at least plurality of fasteners and fabric pockets 53.

The fabric cover 50 includes a plurality of fabric panels, such as the distal panel 52 and the proximate panel 51. The distal panel 52 is positioned vertically to prevent water run-off at the entrance of the canopy 90. In at least one embodiment, because the distal panel 52 is a vertical panel, the distal panel 52 enables the coupling and display of a sign 99 or other identification marking (not shown in the figures). The proximal fabric panel 51 is interlocked or otherwise coupled to the fabric roof 95 by the tension created by the most proximal tent pole 40 being tucked underneath the fabric roof 95.

Figure 3:
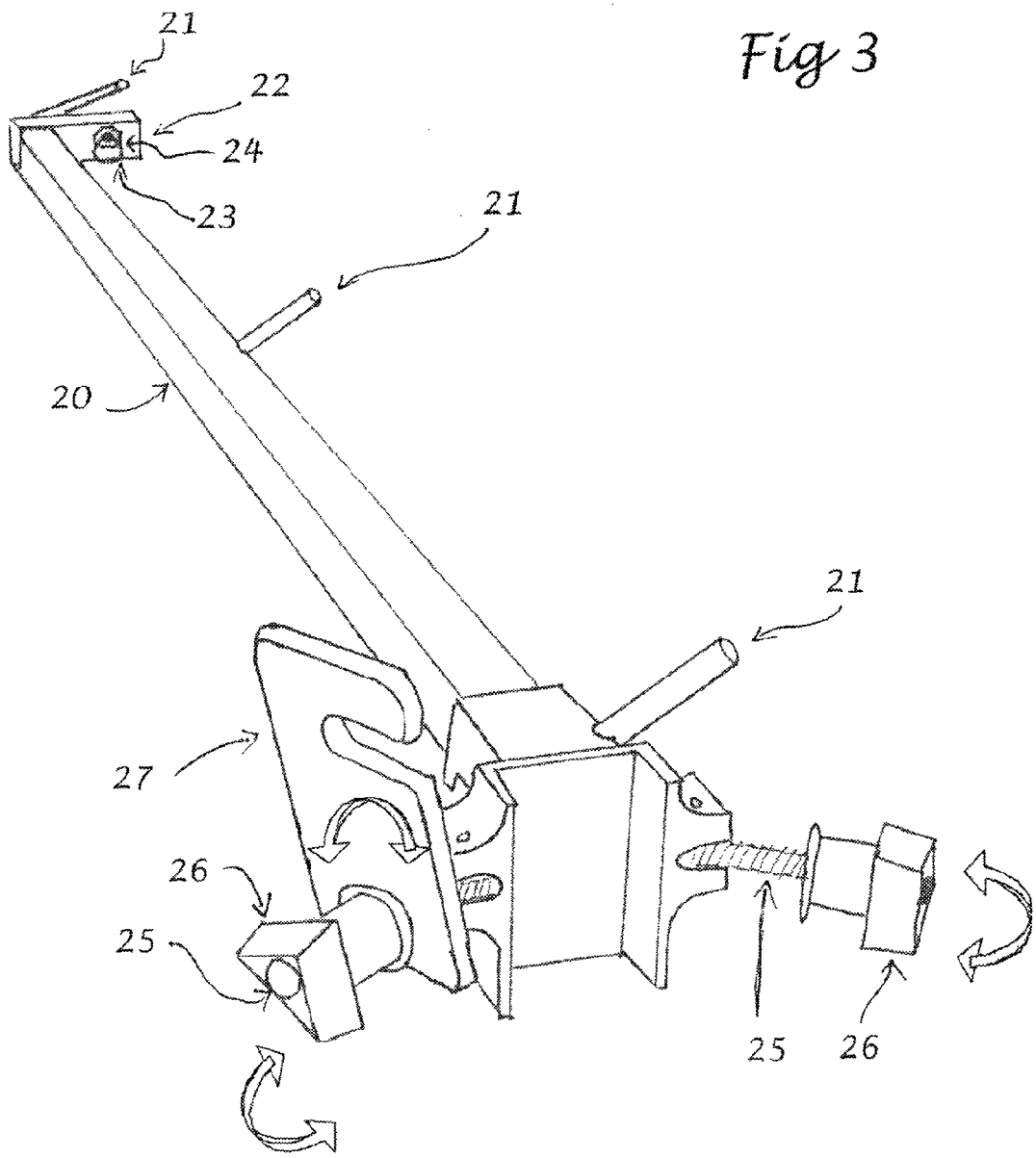
FIG. 3 shows a support arm included in the awning system of FIG. 1 that is consistent with the various embodiments disclosed herein.

FIG. 3 shows a support arm 20 included in the awning system 10 of FIG. 1 that is consistent with the various embodiments disclosed herein. The support arm 20 includes a plurality of receiver pins 21 that are enabled to receive and couple with the plurality of tent poles 40 of FIG. 2. The receiver pins 21 mate with and support the tent poles. Furthermore, the receiver pins 21 enable the arched structure.

Each support arm 20 also includes a lateral or 90° receiver joint 22 at the distal end on the generally longitudinal support arm 20. The receiver joint 22 is oriented in a generally lateral direction and is configured to receive the end of telescoping cross beam 30. The receiver joint 22 also enables the coupling and decoupling of the cross beam 30 via the spring pin 23. The spring pin 23 is coupled to the receiver joint 22 by employing a hex nut 24 that is coupled to the receiver joint 22. In a preferred embodiment, the hex nut 24 is welded to the receiver joint 22.

At the proximal end, each support beam 20 includes a pair of fasteners 25 that form the basis of a universal four-sided clamp. The four-side clamp may be a four-sided quick release clamp. In a preferred, but non-limiting embodiment, the fasteners 25 are swing bolts and are not removable from the four-sided clamp. Another pair of fasteners 26 enables the tightening and loosening of the universal four-sided clamp. The other pair of fasteners 26 may be nuts. A rotating back plate 27 is rotatably couplable to the second irremovable swing bolt 25 via an aperture in the back plate 27. The rotation of the back plate 27 enables the quick release mechanism of the four-sided clamp.

Figure 4:
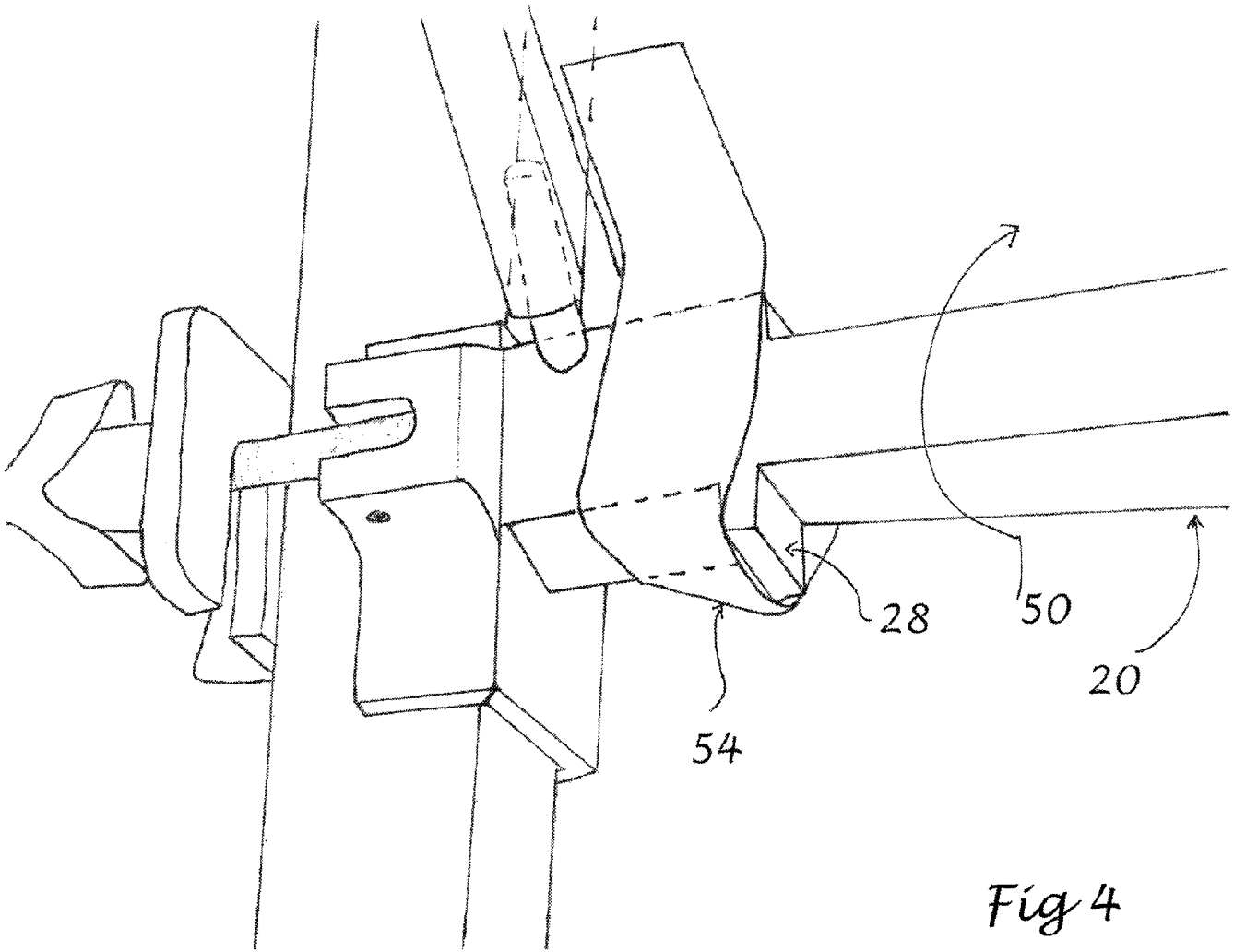
FIG. 4 provides a close-up view of a coupling between the support arm of FIG. 3 and a vertical leg of the canopy of FIG. 1.

FIG. 4 provides a close-up view of a coupling between the support arm 20 of FIG. 3 and a vertical leg 91 of the canopy 90 of FIG. 1. The close-up view reveals a retaining lip 28 positioned in the underside of the support arm 20 and a securing strap 54 included with the fabric cover 50. In a preferred embodiment, the securing strap 54 is at least partially constructed from hook and loop material. The securing strap 54 at least partially enables securing the fabric cover 50 to the frameworks, as well as creates tension on the fabric cover 50 in the lateral and proximal/distal planes.

Figure 5:
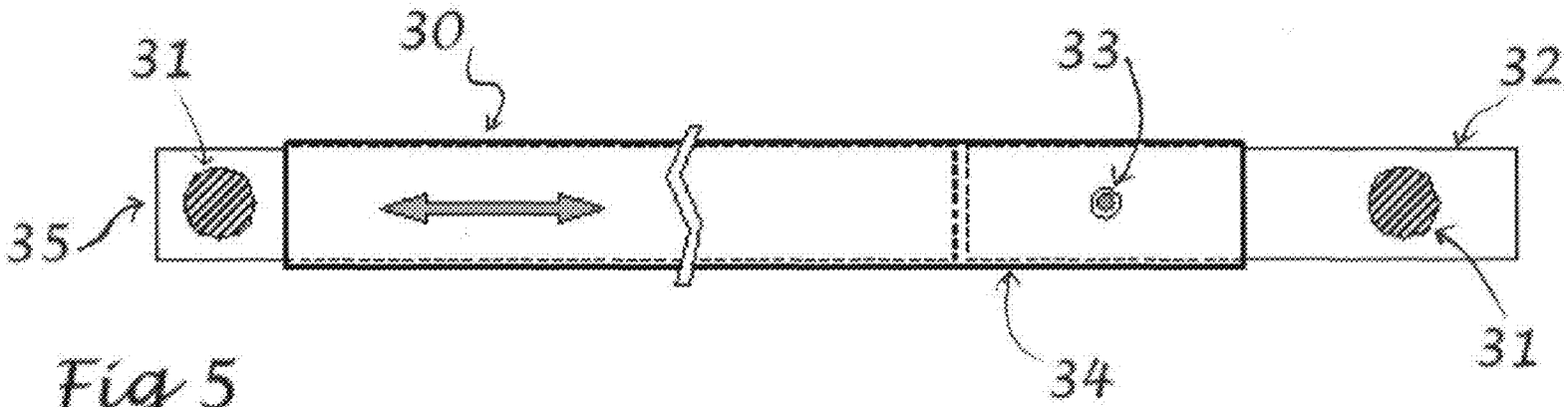
FIG. 5 provides a cutaway view of a support cross beam included in the awning system of FIG. 1 that is consistent with the various embodiments disclosed herein.

FIG. 5 provides a cutaway view of a support cross beam 30 included in the awning system 10 of FIG. 1 that is consistent with the various embodiments disclosed herein. Each lateral end of the telescoping cross beam 30 includes an aperture or hole 31 that is enabled to receive the spring pin 23 of FIG. 3. A fixed end 32 of the telescoping cross beam 30 is received by the receiver joint 22 of the support arm 20, of FIG. 3. A fastener 33 enables the coupling of the fixed end 32 of the telescoping cross beam 30. In a preferred embodiment, fastener 33 is a rivet. The cross beam 30 includes an outer tube 34 and an inner tube 35. The outer tube 34 is coupled into the fixed end 32 and the inner tube 35 telescopes as indicated by the two-sided arrow.

Figure 6:
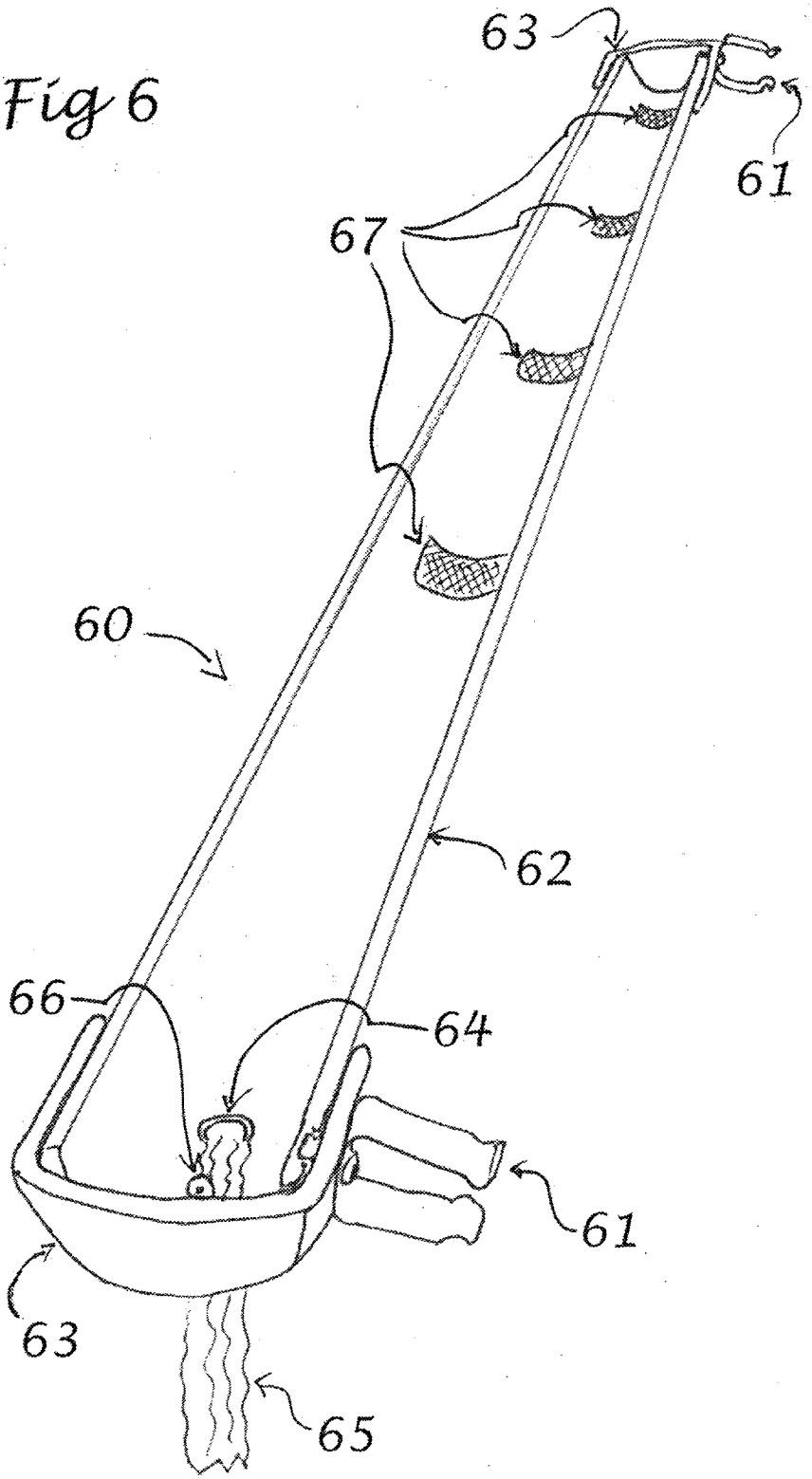
FIG. 6 shows a removable rain gutter that is included in various embodiments of the awning system of FIG. 1.

FIG. 6 shows a removable rain gutter 60 that is included in various embodiments of the awning system 10 of FIG. 1. The removable rain gutter 60 couples or attaches to the support arms 20 of FIG. 3 via fasteners. In a preferred embodiment, a first rain gutter attaches to the first support arm and a second rain gutter attaches to the second arm. In a preferred embodiment, these fasteners are retainer clips 61 positioned at both the proximal and distal ends of the gutter 60. The gutter body 62 of the removable rain gutter 60 includes a portion of a pipe-like structure to form the body 62. The body 62 catches rainwater and enables the flow of the collected the rainwater in the desired direction. The proximal and distal ends of the body 62 are capped with a longitudinally cut end-cap 63 to ensure that rainwater is conveyed in the desired direction.

An aperture of hole 64 is positioned at the proximal end of the body 62 of the removable rain gutter 60. The aperture enables an exit route for the collected rainwater. Upon flowing out of the desired exit route or aperture 64, the water is then conveyed downward on a strip of quick-drying fabric 65. Another fastener 66 enables the coupling and decoupling of the fabric downspout 65 to the removable rain gutter. In a preferred embodiment, the fastener 66 is a rivet. The fabric downspout 65 is then removably couplable to the vertical canopy leg 91 of FIG. 1 by means of yet another fastener.

A plurality of fasteners 67 are coupled to the body 62. In a preferred embodiment, the fasteners are irremovably coupled to the body 62. Other fasteners are configured to couple to the lateral ends of the fabric cover 50 of FIG. 1 to removably couple the gutters 60 to the awing system 10. In a preferred embodiment, the fasteners that are attached to the fabric cover 50 are irremovably attached to the fabric cover. When these fasteners are fastened, the water is effectively conveyed from the fabric cover 50 into the removable rain gutters 60.

In summary, some embodiments of a detachable all-weather awning system for a portable canopy include a plurality of support members comprising a framework, a plurality of fabric panels comprising an awning cover, and a plurality of members comprising detachable rain gutters for the detachable awning.

The plurality of support members include a means for attaching the proximal end of the arm to the vertical leg of the canopy, and an arm extending horizontally from the attachment means. The support members also include a means for attaching a telescoping cross beam to the distal end of the horizontally extended arms, and a telescoping cross beam from the attachment means. The support members further include a means for attaching a plurality of tent poles to the horizontally extended arms, and tent poles attached to these means to form an arched structure. In some embodiments, the support members include a means for attaching a tensioning brace to the proximal and distal awning fabric panels, and a tensioning brace attached to these means and a means for attaching a fabric cover to the framework using a system of fasteners.

The plurality of fabric panels includes an arch-shaped proximal fabric panel that extends downward vertically from the proximal arched tent pole to the framework of the portable canopy, and connects to the canopy framework and tent pole framework using a system of fasteners. The fabric panels further include an arch-shaped distal fabric panel that extends downward vertically from the distal arched tent pole to the telescoping cross beam, and connects to the horizontally extended arms using a system of gusseted corners, and connects to the telescoping cross beam and distal tent pole using a system of fasteners. In at least one embodiment, the fabric panels also include a horizontally placed medial fabric panel attached to the proximal and distal vertical fabric panels by means of mechanically sewn binding, and connects to the framework using a system of fasteners The rain gutters include a means for attaching the rain gutters to the horizontally extended awning arms, and the rain gutters attached to these means to catch and convey rainwater to downspouts. The rain gutters also include a means for attaching the awning fabric cover to the rain gutters using fasteners. The gutters further include a means for attaching a fabric downspout to the rain gutters, and a fabric downspout attached to these means to convey rainwater to the ground and a means for attaching a fabric downspout to the vertical leg of the canopy using a system of fasteners. The means for attaching the proximal end of the horizontally extended arm to the vertical canopy leg is a universal 4-sided quick-connect clamp.

The universal 4-sided quick-connect clamp includes a 3-sided main clamp body that attaches to the distal and lateral sides of various sized vertical canopy legs. The 4-sided clamp may further include a rotating back plate that completes the 4-sided quick-connect clamp and secures to the proximal side of the vertical canopy leg and is irremovably connected to the first irremovable pivoting bolt, wherein the first irremovable pivoting bolt extends through a hole on one side of the back plate and is rendered irremovable by an irremovably connected nut. The back plate is slotted on the opposite side to rotate in place to accommodate the second irremovable pivoting bolt. The clamp further includes two pivoting bolts that are irremovably connected to the 3-sided main clamp body. The clamp may include ergonomic nuts that are irremovably connected to the irremovable pivoting bolts to secure the quick-connect clamp on the proximal end of the horizontally extended awning arm to the vertical leg of the canopy.

The horizontally extending arm includes a member with a 4-sided universal quick-clamp at the proximal end for connecting to various sized vertical canopy legs. The member may also include an irremovable 90° lateral joint at the distal end for receiving the telescoping cross beam. The member includes a plurality of irremovable receiver pins for receiving the ferrules of the tent poles to create the arched structure. Also included is a means for securing the proximal lateral fastener of the fabric cover, wherein the horizontally extending arm has a downwardly extending lip behind which the fastener is fastened.

The telescoping cross beam includes an outer tube and a long inner tube that telescopes laterally within the outer tube and has a hole at the lateral end to receive a quick-release pin. The cross beam may also include a short inner tube that is irremovably connected at the lateral end opposite the telescoping end and has a hole to receive a quick-release pin. The short fixed inner tube is fixed in such a way that when the telescoping cross beam is connected to the horizontally extending arms, a finger-pinch-prevention gap is maintained between the outer tube of the telescoping cross beam and the 90° receiver joint of the horizontally extending arm.

The means for attaching the lateral ends of the telescoping cross beam to the distal ends of the horizontally extended arms may be a quick-release pin. The awning has a laterally arched shape supported by tent poles to convey rainwater to the sides of the awning. The proximal and distal fabric panels extend downward vertically from their respective tent poles to form vertical flat panels. The distal fabric panel can be used as signage.

The proximal fabric panel and its respective tent pole are overlapped by the fabric of the canopy to form a fabric interlock between the awning fabric and canopy fabric. The proximal and distal vertical fabric panels have fabric pockets for receiving a tension brace. A tension brace is removably placed between the bottom of the proximal vertical fabric panel at the medial point and the top of the distal vertical fabric panel at the medial point using a system of fabric pockets. The distal vertical fabric panel and the medial horizontal fabric panel are joined at the lateral sides to form a fabric pocket for the purpose of receiving the 90° receiver joint of the horizontally extending arm. The medial horizontal fabric panel has a plurality of fasteners at the lateral sides to secure to the horizontally extended arm.

In at least some embodiments, the rain gutters include a plurality of members. The rain gutter members include a transectionally and longitudinally cut member of pipe. The members may also include a longitudinally cut end-cap irremovably connected to the proximal and distal ends of the pipe member. Further included are retainer clips irremovably attached to the proximal and distal ends of the gutters. In a preferred embodiment, the gutters include a drain hole at the proximal end of the rain gutter. Fabric downspouts are also included that are irremovably connected at the proximal end of the rain gutters and removably connected to the vertical canopy legs using a fastener.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A modular all-weather awning system that is configured and arranged to removably couple to a canopy that includes a first and a second leg, the system providing protection from weather elements and comprising:

a frame assembly comprising:

a cross member that includes a first and a second end;

a first support member that includes a first canopy coupler positioned at a first proximal end and a first receiver coupler positioned at a first distal end; and a second support member that includes a second canopy coupler positioned at a second proximal end and a second receiver coupler positioned at a second distal end, wherein a frame is formed by coupling the first receiver coupler to the cross member's first end and coupling the second receiver coupler to the cross member's second end, such that the first and second support members are substantially parallel members and each is substantially orthogonal to the cross member;

a cover that is configured and arranged to couple to the frame, wherein the frame couples to the canopy by coupling the first canopy coupler to the canopy's first leg and coupling the second canopy coupler to the canopy's second leg, such that the cover provides protection, from the weather elements, to an area below the frame; and a rain gutter configured to couple to at least one of the first support member and the second support member and to collect water that is incident on the cover, wherein the rain gutter includes:

a longitudinally cut member of a pipe;

a longitudinally cut end-cap that is connected to an end portion of the pipe;

a drain hole at the end of the pipe;

a first and a second retainer clip, wherein each of the first and the second retainer clips are enabled to attach the rain gutter to the at least one of the first support member and the second support member; and a fabric downspout configured and arranged to removably couple to a leg of the canopy.

2. The system of claim 1, wherein the frame assembly further comprises a plurality of lateral members that form an arch structure when the cover is coupled to the frame.

3. The system of claim 1, wherein the first canopy coupler includes:

a trench that is configured and arranged to receive the canopy's first leg; and a backplate that is configured and arranged to couple to the trench and secure a positioning of the first leg when received by the trench.

4. The system of claim 3, wherein the backplate includes a slot to receive a fastener that couples the backplate to the trench.

5. The system of claim 1, wherein the cover includes a securing strap that at least partially enables coupling the cover to the first support member and the first support member includes a retaining lip that is configured and arranged to secure a positioning of the of securing strap about the first support member.

6. The system of claim 1, wherein the cover includes a distal panel that is positioned vertically and a proximate panel that couples to a fabric included in the canopy.

7. An awning assembly that comprises:

a frame that includes a first and a second canopy fastener and a cross member, wherein the first and the second canopy fasteners are configured and arranged to couple the frame to a canopy assembly and a width of the frame is adjustable based on an adjustable length of the cross member;

a fabric cover that is configured and arranged to stretch over the frame; and a rain gutter that is configured and arrange to couple to the frame and collect and channel moisture from the fabric cover, wherein the rain gutter includes:

a longitudinally cut member of a pipe;

a longitudinally cut end-cap that is connected to an end portion of the pipe;

a drain hole at the end of the pipe;

a first and a second retainer clip, wherein each of the first and the second retainer clips are enabled to attach the rain gutter to the frame; and a fabric downspout configured and arranged to removably couple to the canopy assembly.

8. The assembly of claim 7, wherein the frame includes an arch such that when the cover is stretched over the frame, the cover is arched to enhance the collection of moisture in the rain gutter.

9. The assembly of claim 8, wherein the arch is at least partially formed by a flexible tent pole.

10. The assembly of claim 7, wherein the fabric cover includes a vertical portion that is substantially orthogonal to the rain gutter.

11. The assembly of claim 10, further comprising a sign that is configured and arranged to couple to the vertical portion of the fabric cover.

12. The assembly of claim 7, wherein each of the first and the second canopy fasteners includes a quick-release clamp.

13. A detachable all-weather awning for a portable canopy, comprising:

a framework that includes a proximal arched tent pole, a distal arched tent pole, a first side arm, a second arm, and a telescoping cross beam wherein the first and second side arms are configured and arranged to be attached to the canopy;

an awning cover that includes at least an arch-shaped proximal fabric panel and an arch-shaped distal fabric panel, wherein the proximal fabric panel extends from the proximal tent pole to the canopy and the distal fabric panel extends downward vertically from the distal tent pole to the telescoping cross beam; and a detachable rain gutter, wherein the rain gutter includes:

a longitudinally cut member of a pipe;

a longitudinally cut end-cap that is connected to an end portion of the pipe;

a drain hole at the end of the pipe;

a first and a second retainer clip, wherein each of the first and the second retainer clips are enabled to attach the rain gutter to the first side arm of the framework; and a fabric downspout configured and arranged to removably couple to a leg of the canopy.

14. The awning of claim 13, wherein the fabric cover further comprises a horizontally placed medial fabric panel attached to the proximal and distal fabric panels.

15. The awning of claim 13, wherein the framework includes a 4-sided clamp that attaches the first side arm to a first leg of the canopy, wherein the 4-sided clamp includes:

a 3-sided main clamp body that attaches to the first leg of the canopy; and a backplate the completes the 4-sided clamp and secures a position of the 4-sided clamp about the first leg of the canopy.

16. The awning of claim 13, wherein the telescoping cross beam includes:

an outer tube;

a long inner tube that telescopes laterally within the outer tube and has a first aperture at a lateral end that is configured and arranged to receive a pin; and a short inner tube that is coupled to the lateral end of the long inner tube and has a second aperture that is configured and arranged to receive the pin.

* * * * *